United States Patent [19]

Eggers et al.

[11] Patent Number: 4,961,869

[45] Date of Patent: Oct. 9, 1990

[54] TERNARY AZEOTROPIC COMPOSITIONS OF 2,3-DICHLORO-1,1,1,3,3-PENTAFLUORO-PROPANE WITH TRANS-1,2-DICHLOROETHYLENE AND METHANOL

[75] Inventors: Michael E. Eggers, Chesterton, Ind.; Abid N. Merchant, Wilmington, Del.

[73] Assignee: E. I. Du Pont de Nemours and Company, Wilmington, Del.

[21] Appl. No.: 389,383

[22] Filed: Aug. 3, 1989

[51] Int. Cl.[5] ..... C11D 7/30; C11D 7/50

[52] U.S. Cl. ..... 252/170; 252/162; 252/172; 252/364; 252/DIG. 9; 134/38

[58] Field of Search ..... 252/162, 170, 172, 364, 252/DIG. 9; 203/67; 134/12, 38, 39, 40

[56] References Cited

U.S. PATENT DOCUMENTS 4,582,733 4/1986 McCord ..... 427/430.1

4,828,751 5/1989 Kramer ..... 252/171

*Primary Examiner*—Paul Lieberman

*Assistant Examiner*—Kathleen Markowski

[57] ABSTRACT

Azeotropic mixtures of 2,3-dichloro-1,1,1,3,3-pentafluoropropane (HCFC-225da) and trans-1,2-dichloroethylene (HCC-1130) with methanol, the azeotropic mixtures being useful in solvent cleaning applications.

5 Claims, No Drawings

TERNARY AZEOTROPIC COMPOSITIONS OF 2,3-DICHLORO-1,1,1,3,3-PENTAFLUOROPROPANE WITH TRANS-1,2-DICHLOROETHYLENE AND METHANOL

BACKGROUND OF THE INVENTION

As modern electronic circuit boards evolve toward increased circuit and component densities, thorough board cleaning after soldering becomes a more important criterion. Current industrial processes for soldering electronic components to circuit boards involve coating the entire circuit side of the board with flux and thereafter passing the flux-coated board over preheaters and through molten solder. The flux cleans the conductive metal parts and promotes solder fusion. Commonly used solder fluxes generally consist of rosin, either used alone or with activating additives, such as amine hydrochlorides or oxalic acid derivatives.

After soldering, which thermally degrades part of the rosin, the flux-residues are often removed from the circuit boards with an organic solvent. The requirements for such solvents are very stringent. Defluxing solvents should have the following characteristics: a low boiling point, be nonflammable, have low toxicity and have high solvency power, so that flux and flux-residues can be removed without damaging the substrate being cleaned.

While boiling point, flammability and solvent power characteristics can often be adjusted by preparing solvent mixtures, these mixtures are often unsatisfactory because they fractionate to an undesirable degree during use. Such solvent mixtures also fractionate during solvent distillation, which makes it virtually impossible to recover a solvent mixture with the original composition.

On the other hand, azeotropic mixtures, with their constant boiling points and constant compositions, have been found to be very useful for these applications. Azeotropic mixtures exhibit either a maximum or minimum boiling point and they do not fractionate on boiling. These characteristics are also important when using solvent compositions to remove solder fluxes and flux-residues from printed circuit boards. Preferential evaporation of the more volatile solvent mixture components would occur, if the mixtures were not azeotropes and would result in mixtures with changed compositions, and with attendant less-desirable solvency properties, such as lower rosin flux solvency and lower inertness toward the electrical components being cleaned. The azeotropic character is also desirable in vapor degreasing operations, where redistilled solvent is generally employed for final rinse cleaning. In summary, vapor defluxing and degreasing systems act as a still. Unless the solvent composition exhibits a constant boiling point, i.e., is an azeotrope, fractionation will occur and undesirable solvent distributions will result, which could detrimentally affect the safety and efficacy of the cleaning operation.

A number of chlorofluorocarbon based azeotropic compositions have been discovered and in some cases used as solvents for solder flux and flux-residue removal from printed circuit boards and also for miscellaneous degreasing applications. For example: U.S. Pat. No. 3,903,009 discloses the ternary azeotrope of 1,1,2-trichlorotrifluoroethane with ethanol and nitromethane; U.S. Pat. No. 2,999,815 discloses the binary azeotrope of 1,1,2-trichlorotrifluoroethane and acetone; U.S. Pat. No. 2,999,817 discloses the binary azeotrope of 1,1,2-trichlorotrifluoroethane and methylene chloride.

Some of the chlorofluorocarbons which are currently used for cleaning and other applications have been theoretically linked to depletion of the earth's ozone layer. As early as the mid-1970's, it was known that introduction of hydrogen into the chemical structure of previously fully-halogenated chlorofluorocarbons reduced the chemical stability of these compounds. Hence, these now destabilized compounds would be expected to degrade in the lower atmosphere and not reach the stratospheric ozone layer in-tact. What is also needed, therefore, are substitute hydrochlorofluorocarbons which have low theoretical ozone depletion potentials.

Unfortunately, as recognized in the art, it is not possible to predict the formation of azeotropes. This fact obviously complicates the search for new azeotropic compositions, which have application in the field. Nevertheless, there is a constant effort in the art to discover new azeotropes, which have desirable solvency characteristics and particularly greater versatilities in solvency power.

SUMMARY OF THE INVENTION

According to the present invention, azeotropic compositions have been discovered comprising admixtures of effective amounts of 2,3-dichloro-1,1,1,3,3-pentafluoropropane with trans-1,2-dichloroethylene and methanol. The azeotrope is an admixture of about 43–53 weight percent 2,3-dichloro-1,1,1,3,3-pentafluoropropane and about 42–52 weight percent trans-1,2-dichloroethylene and about 3–9 weight percent methanol. The present invention provides nonflammable azeotropic compositions which are well suited for solvent cleaning applications.

DETAILED DESCRIPTION OF THE INVENTION

The composition of the instant invention comprises an admixture of effective amounts of 2,3-dichloro-1,1,1,3,3-pentafluoropropane (CF3—CHCl —$CClF_2$, bOiling point = 50.4° C.) and trans-1,2-dichloroethylene (CHCl=CHCl, boiling point = 48.0° C.) and methanol (boiling point =64.6° C.), to form an azeotrope or azeotrope-like mixture. The aforementioned halocarbons are known as HCFC-225da and trans-HCC-1130, respectively, in the nomenclature conventional to the halocarbon field.

By consisting essentially of an azeotrope is meant, a constant boiling liquid admixture of three or more substances, whose admixture behaves as a single substance, in that the vapor, produced by partial evaporation or distillation of the liquid has the same composition as the liquid, i.e., the admixture distills without substantial composition change. Constant boiling compositions, which are characterized as azeotropes, exhibit either a maximum or minimum boiling point, as compared with that of the nonazeotropic mixtures of the same substances.

By consisting essentially of an azeotrope is meant the amount of each component of the instant invention admixture, which when combined, results in the formation of the azeotrope of the instant invention. The language "consisting essentially of an azeotrope" is not meant to exclude the presence of other materials which do not significantly alter the azeotropic behavior of the ternary azeotropic composition of the present invention.

It is possible to fingerprint, in effect, a constant boiling admixture, which may appear under many guises, depending upon the conditions chosen, by any of several criteria:

* The composition can be defined as an azeotrope of A, B and C, since the very term "azeotrope" is at once both definitive and limitative, and requires that effective amounts A, B and C form this unique composition of matter, which is a constant boiling admixture.

* It is well known by those skilled in the art that at different pressures, the composition of a given azeotrope will vary — at least to some degree and changes in pressure will also change — at least to some degree — the boiling point temperature. Thus an azeotrope of A, B and C represents a unique type of relationship but with a variable composition which depends on temperature and/or pressure. Therefore compositional ranges, rather than fixed compositions, are often used to define azeotropes.

* The composition can be defined as a particular weight percent relationship or mole percent relationship of A, B and C, while recognizing that such specific values point out only one particular such relationship and that in actuality, a series of such relationships, represented by A, B and C actually exist for a given azeotrope, varied by the influence of pressure.

* Azeotrope A, B and C can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Ternary mixtures of 43–53 weight percent 35 2,3-dichloro-1,1,1,3,3-pentafluoropropane and 42–52 weight percent trans-1,2-dichloroethylene and 3–9 weight percent methanol are characterized as azeotropes, in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true ternary azeotrope. The ternary composition consisting of about 47.7 weight percent 2,3-dichloro-1,1,1,3,3-pentafluoropropane, 46.7 weight percent trans-1,2-dichloroethylene and 5.6 weight percent methanol has been established, within the accuracy of the fractional distillation method, as a true ternary azeotrope, boiling at about 41.0° C., at substantially atmospheric pressure.

The aforestated azeotrope has a low ozone-depletion potential and is expected to decompose almost completely, prior to reaching the stratosphere.

The azeotrope of the present invention permits easy recovery and reuse of the solvent from vapor defluxing and degreasing operations because of its azeotropic nature. As an example, the azeotropic mixture of this invention can be used in cleaning processes such as described in U.S. Pat. No. 3,881,949, which is incorporated herein by reference.

The azeotrope of the present invention can be prepared by any convenient method including mixing or combining the desired component amounts. A preferred method is to weigh the desired component amounts and thereafter combine them in an appropriate container.

EXAMPLE 1

A solution which contained 58.7 weight percent 2,3-dichloro-1,1,1,3,3-pentafluoropropane, 36.8 weight percent trans-1,2-dichloroethylene and 4.5 weight percent methanol was prepared in a suitable container and mixed thoroughly.

The solution was distilled in 25 plate Oldershaw distillation column, using about a 5:1 reflux to take-off ratio. Head and pot temperatures were read directly to 0.1C. All temperatures were adjusted to 760 mm pressure. Distillate compositions were determined by gas chromatography. Results obtained are summarized in Table 1.

TABLE 1

Distillation of: (58.7 + 36.8 + 4.5) 2,3-DICHLORO-1,1,1,3,3-PENTAFLUOROPROPANE (DCPFP), TRANS-1,2-DICHLOROETHYLENE (T-DCE) AND METHANOL (MEOH)

| Cuts | Temperature, °C. Head | Wt. % Distilled or Recovered | DCPFP | T-DCE | MEOH |
|---|---|---|---|---|---|
| 1 | 41.0 | 1.9 | 47.5 | 46.9 | 5.6 |
| 2 | 40.9 | 11.5 | 47.4 | 47.0 | 5.6 |
| 3 | 41.0 | 19.8 | 47.4 | 46.9 | 5.7 |
| 4 | 41.0 | 28.7 | 47.5 | 46.8 | 5.7 |
| 5 | 41.0 | 38.0 | 47.5 | 46.8 | 5.7 |
| 6 | 41.1 | 48.8 | 48.3 | 46.2 | 5.5 |
| 7 | 41.5 | 57.3 | 50.4 | 44.3 | 5.3 |
| heel | — | 87.9 | 85.9 | 12.2 | 1.9 |

Analysis of the above data indicates nearly constant head temperatures and distillate compositions, as the distillation progressed. A statistical analysis of the data indicates that the true ternary azeotrope of 2,3-dichloro-1,1,1,3,3-pentafluoropropane, trans-1,2-dichloroethylene and methanol has the following characteristics at atmospheric pressure (99 percent confidence limits):

| | |
|---|---|
| 2,3-Dichloro-1,1,1,3,3-pentafluoropropane | = 47.7 ± 1.8 wt. % |
| trans-1,2-Dichloroethylene | = 46.7 ± 1.5 wt. % |
| Methanol | = 5.6 ± 0.4 wt. % |
| Boiling Point, °C. | = 41.0 ± 0.3 |

EXAMPLE 2

Several single sided circuit boards were coated with activated rosin flux and soldered by passing the boards over a preheater, to obtain top side board temperatures of approximately 200° F. (93° C.), and then through 500° F. (260° C.) molten solder. The soldered boards were defluxed separately, with the azeotropic mixture cited in Example 1 above, by suspending a circuit board, first, for three minutes in the boiling sump, which contained the azeotropic mixture, then, for one minute in the rinse sump, which contained the same azeotropic mixture, and finally, for one minute in the solvent vapor above the boiling sump. The boards cleaned in the azeotropic mixture had no visible residue remaining thereon.

We claim:

1. The azeotropic composition consisting essentially of from about 43–53 weight percent 2,3-dichloro-1,1,1,3,3-pentafluoropropane, about 42–52 weight percent trans-1,2-dichloroethylene and about 3–9 weight percent methanol wherein the composition has a boiling point of about 41.0° C. at substantially atmospheric pressure.

2. The azeotropic composition of claim 1 wherein the composition is about 47.7 weight percent 2,3-dichloro-1,1,1,3,3-pentafluoropropane, and about 46.7 weight percent trans-1,2-dichloroethylene and about 5.6 weight percent methanol.

3. A process for cleaning a solid surface comprises treating said surface with the azeotropic composition of claim 1.

4. The process of claim 3, wherein the solid surface is a printed circuit board contaminated with flux and flux-residues.

5. The process of claim 4, wherein the solid surface is a metal.

* * * * *